US005993280A

United States Patent [19]

Rödhammer et al.

[11] Patent Number: 5,993,280

[45] Date of Patent: Nov. 30, 1999

[54] METHOD FOR MANUFACTURING A ROTARY ANODE ASSEMBLY

[75] Inventors: Peter Rödhammer; Dietmar Sprenger, both of Reutte, Austria

[73] Assignee: Schwarzkopf Technologies, Franklin, Mass.

[21] Appl. No.: 09/177,203

[22] Filed: Oct. 22, 1998

[30] Foreign Application Priority Data

Oct. 30, 1997 [AT] Austria ..... 1833/97

[51] Int. Cl.[6] ..... H01J 9/00

[52] U.S. Cl. ..... 445/28

[58] Field of Search ..... 445/28

[56] References Cited

U.S. PATENT DOCUMENTS 4,276,493 6/1981 Srinivasa et al. ..... 313/330

FOREIGN PATENT DOCUMENTS 2425 082 A1 11/1975 Germany .

44940 3/1985 Japan ..... 445/25

*Primary Examiner*—Kenneth J. Ramsey

*Attorney, Agent, or Firm*—Morgan & Finnegan LLP

[57] ABSTRACT

The invention pertains to a method for manufacturing a rotary anode assembly for an X-ray tube. According to the invention, a base element made of graphite is joined in a first step as a blank with excess dimensions to a shaft by material bonding. Then the further processing of the rotary anode assembly takes place by mechanical machining to nearly final-form dimensions and by application of the focal track coating, wherein the axis of rotation of the shaft is utilized as the reference for the performance of the mechanical machining.

6 Claims, 1 Drawing Sheet

METHOD FOR MANUFACTURING A ROTARY ANODE ASSEMBLY

BACKGROUND OF THE INVENTION

1. Field of the Invention

The invention relates to a method of manufacture of a rotary anode assembly for an X-ray tube, and more particularly to a method wherein the base element consists of graphite or some other carbon based or ceramic material and the focal track is applied by a coating process.

2. Description of the Related Art

As a general rule, rotary anodes for X-ray tubes consist of a disk-shaped base element with an annular focal track coating of a high-melting-point metal or alloy, which generates the desired X-radiation by electron bombardment of the focal track coating.

The center area of the base element is connected to a cylindrical hollow metal shaft which is in turn connected to a rotor as the drive element of the rotary anode.

Rotary anode assemblies with a metal disk as the supporting base element usually have a central through-hole in the finish-machined rotary anode base element, into which the shaft is inserted and mechanically connected by a threaded fastening. In this way, a secure, sufficiently stable connection of these two mechanical components is achieved.

Rotary anodes must be accelerated in operation to a very high circumferential velocity within an extremely short period of time. For this reason, and particularly for large rotary anode dimensions, as required, in particular, for computer tomography, the heavy metal base elements are often replaced by those made of graphite or some other highly heat-resistant material based on carbon or ceramics with a lower specific gravity.

The advantage of the lower specific gravity of these materials as compared to metals with a comparable thermal capacity, however, is often accompanied by the disadvantage of lower strength, which can have a negative effect, in particular, regarding the connection between the rotary anode base element and the shaft.

Thus it is particularly disadvantageous that rotary anodes of low-density but weaker materials tend to burst when the base element is provided with a central through-hole for mechanical connection to the shaft. Such a connection of rotary anode and shaft is described, for instance, in U.S. Pat. No. 4,276,493. In order to eliminate this disadvantage, particularly when graphite is used as the base element, there have been suggestions to connect the shaft to the base element by soldering, without a through hole.

DE 24 25 082 A1, for instance, describes connecting rotary anode base elements to hollow shafts by welding and/or soldering. Among others, the connection of a base element made of graphite to the shaft is described. For the connection, the finish-machined base element with the focal track applied is inserted by a central cylindrical projection formed onto the bottom side into the tubular shaft and then the end of the projection is welded to the inside wall of the shaft. The formed projection, however, is not suitable to the material for strength reasons, even with large transition radii between base element and projection. Due to notch effects, material cracks can result, which can bring about a failure of the rotary anode in operation.

According to another example, in which the finish-coated and machined rotary anode base element with an end that is closed or expanded like a collar is butt-soldered to the tubular shaft, it is necessary to provide at least a centering aid in the form of a central depression in the rotary anode base element. Since the solder must be inserted between the contact surfaces in this type of soldering, a lateral displacement or tilting of the rotary anode base element with respect to the longitudinal axis of the shaft can often occur upon liquefaction of the solder during the soldering process, despite the centering aid. This leads to an eccentricity of the rotary anode in the radial or axial direction, which must be compensated for by mechanical machining after the soldering process. The compensation for an eccentricity in the axial direction is particularly costly for rotary anodes with a focal track applied by a coating process, since the coating must be applied to a corresponding excess dimension in order to permit a subsequent compensation of the eccentricity without the focal track becoming too thin at any one point. Since the material of the focal track is expensive, and the coating processes are inherently cost-intensive, any necessity to increase the layer thickness is a serious defect. Additionally, differing thicknesses of the focal track coating on the rotary anode cause a differing roughening behavior of the focal track, which is likewise undesired for usage.

For these reasons, it is desired to produce rotary anodes of highly heat-resistant materials with good strength such as, in particular, graphite, with a focal track coating applied by a coating process and without a central through-hole of the rotary anode base element.

SUMMARY OF THE INVENTION

It is therefor an object to fabricate and provide a rotary anode assembly of an X-ray tube by soldering a substantially solid base element of graphite to a shaft, thus forming a rotary anode assembly; grinding the rotary anode assembly to substantially final dimensions; applying a focal track coating of rhenium approximately 100 $\mu$m thick to the rotary anode assembly using vacuum plasma spraying; and grinding the rotary anode assembly with focal track coating to final dimensions. The grinding and coating steps using the shaft as an axis of rotation.

It is also an object of the invention to fabricate and provide a rotary anode assembly for an X-ray tube by bonding a substantially solid base element made of highly heat-resistant material to a shaft, thus forming a rotary anode assembly; machining the rotary anode assembly to substantially final dimensions; and applying a focal track coating to the rotary anode assembly.

DETAILED DESCRIPTION OF THE INVENTION

Figure 1:
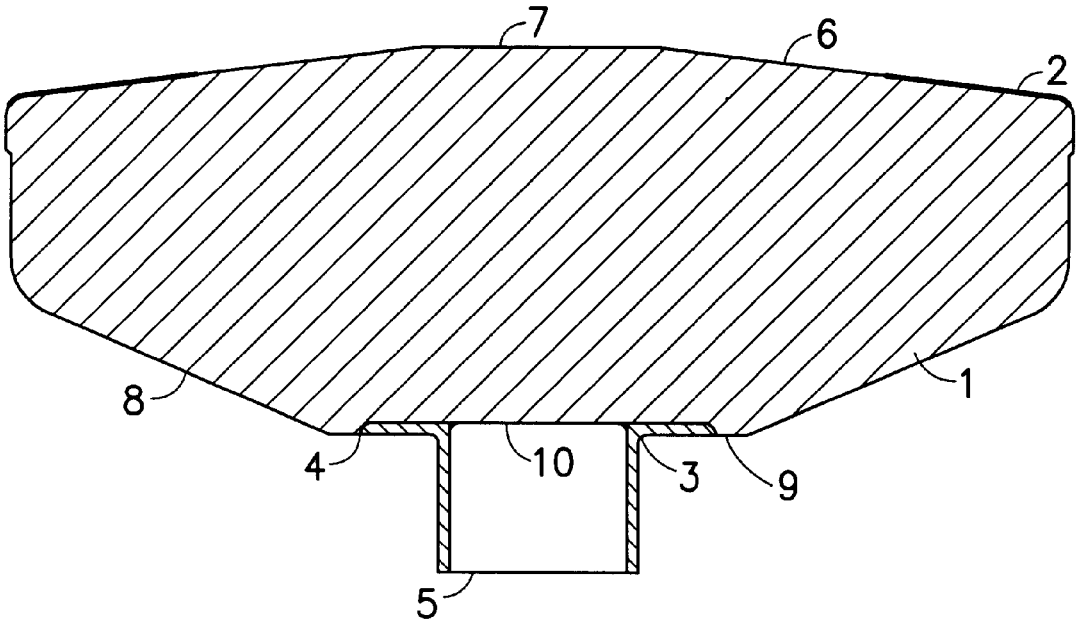
FIG. 1 illustrates a rotary anode according to the present invention.

The method of the present invention produces rotary anodes of highly heat-resistant materials with high strength with a focal track coating that is applied by a coating process. The method is thus economical and precise while providing the required mechanical stability in the connection between the rotary base element and shaft.

In the method according to the invention, in a first process step, an oversized substantially solid base element blank without an axial through-hole drilled in it is connected by a material bond to the shaft to form a rotary anode assembly. Then the rotary anode base element is further processed into substantially final dimensions by mechanical machining. In this step, the focal track coating is also applied and, optionally, mechanical machining to the precise final dimension takes place. In this manner, the axis of rotation of the shaft is used as the reference for performing the respective mechanical machining steps.

By using this method, any lateral slippage or axial tilting of the parts with respect to one another during the joining of shaft and base element is unimportant. The precise alignment of the parts with respect to one another is achieved by mechanical machining using the axis of rotation of the shaft as a reference. With the method according to the invention, it is even conceivable to position and join the shaft to the base element without any centering aid, so that any type of recess in the base element can be omitted.

Depending on the type of coating process with which the focal track coating is applied, it may be necessary to re-machine the rotary anode assembly mechanically to the precise final dimensions after the application of the coating. In an application of the focal track coating with a plasma vapor deposition (PVD) process, for instance, a generally very uniform and smooth layer is achieved, of which the desired layer thickness can be well controlled within narrow limits. Using a PVD coating process, the precise final dimension of the rotary anode assembly is already achieved with the application of the coating, so that subsequent mechanical machining can be generally omitted. If the focal track coating is applied with a plasma spraying process, the coating is somewhat rougher and less uniform as compared to the PVD process. With plasma spraying, a mechanical fine machining of the coating in order to achieve the precise final dimensions of the rotary anode assembly will be expedient.

The application of the method according to the invention is particularly advantageous if the material bond of the shaft to the base element is achieved by a soldering process. When the shaft and base element are soldered, a relatively large displacement or tilting of the parts can easily occur. The method according to the invention nevertheless permits highly precise alignment of the parts in the finish-machined state of the rotary anode assembly.

An advantageous variant of the method according to the invention provides that first the uncoated base element is bonded to the shaft forming the rotary anode assembly. Then, the shaft is clamped into the chuck of a lathe and the base element is turned to nearly final-form dimensions. In an additional step, the application of the focal track coating is done by vacuum plasma spraying. Finally, the rotary anode assembly is brought to final dimensions by grinding of the focal track coating.

It is particularly economical if the shaft of the rotary anode assembly is clamped, during the application of the focal track coating by plasma spraying, into a receptacle which sets the rotary anode into rotation at a constant spacing from the plasma cannon.

The application of the method according to the invention is particularly indicated if rhenium, a very expensive material, is employed for the focal track coating, since then the cost savings from the achievable layer uniformity without expensive subsequent material removal comes fully into play. The application of the focal track coating with layer thicknesses between 60 and 150 $\mu$m, in particular, roughly 100 $\mu$m, is sufficient in this case.

FIG. 1 shows in cross section, a finish-machined rotary anode assembly, consisting of a disk-shaped base element 1 of graphite, an annular focal track coating 2 of rhenium as well as a hollow shaft 3 of TZM with a shoulder-like end 4 that is soldered to base element 1.

Base element 1 has a diameter of 180 mm and a maximum thickness of 64 mm. Conical surface 6 bearing the focal track on the upper side has an angle of inclination of 7° to the horizontal and transforms into a central horizontal area 7. The focal track layer 2 has a layer thickness of 100 $\mu$m. The conical surface 8 on the bottom is inclined by 20° to the horizontal and transforms into a central horizontal area 9. The area 9 is provided with a 2-mm-deep recess 10 in which the hollow shaft 3 with its collar-like end 4 is soldered. The hollow shaft 3 made of TZM has an outside diameter of 34 mm and a wall thickness of 2.5 mm. The collar-like end 4 has an outside diameter of 65 mm. In order to produce the rotary anode assembly according to FIG. 1, the recess 10 was first worked into a disk-shaped blank made of graphite, with an outside diameter of 185 mm and a thickness of 68 mm, on a lathe. The diameter of the recess 10 had an oversizing of 0.15 mm in diameter by comparison to the collar-like end 4 of the hollow shaft 3. Thereafter the blank was soldered to the finish-machined hollow shaft at 1600° C. with the insertion of zirconium foil as solder. Subsequently, the blank soldered to the hollow shaft 3 is clamped on the hollow shaft on a lathe and, apart from the conical surface 6 on the top side, the desired final contour of the rotary anode is produced, with a slight overall oversizing of ca. 0.5 mm. The conical surface 6, on the other hand, was turned down to the desired final contour minus an undersizing corresponding to the finish-machined coating thickness of 100 $\mu$m.

After this mechanical machining, the focal track coating 2 of the rotary anode assembly is produced by means of vacuum plasma-spray deposition in the form of a rhenium layer approximately 130 $\mu$m thick. Subsequently, the focal track coating was ground down to the nominal dimension of 100 $\mu$m and the precise final dimensions of the rotary anode assembly were produced by turning down all remaining surfaces. Subsequently the rotary anode was balanced.

The rotary anode manufactured in this manner was finally measured, and an extremely small, non-disruptive eccentricity of 12 $\mu$m in the axial direction was found. The eccentricity radially was 27 $\mu$m.

The example describes a particularly advantageous variant of the method according to the invention for producing a rotary anode assembly. The invention is by no means restricted to this variant, however.

Thus it is also conceivable to bring all surfaces other than the surface that bears the focal track to the precise final dimensions and to machine the surface bearing the focal track mechanically to an undersize such that the precise final dimensions of the entire rotary anode assembly are achieved after applying the coating, with or without additional mechanical machining.

It is likewise conceivable to butt-solder the closed or collar-like widened end of the shaft to the graphite surface without any recess in the graphite.

Neither is the material for the shaft restricted to the molybdenum alloy TZM. Other highly heat-resistant alloys, based for instance on niobium or tantalum, or fiber-reinforced materials based on carbon or ceramics, likewise come into consideration.

Besides graphite, fiber-reinforced materials based on carbon or ceramic can also be advantageously used for the material of the base element.

Although an illustrative embodiment of the present invention, and various modifications thereof, have been described in detail herein with reference to the accompanying drawing, it is to be understood that the invention is not limited to these precise embodiments and the described modifications, and that the various changes and further modifications may be effected therein by one skilled in the art without departing from the scope or spirit of the invention as defined in the appended claims.

We claim:

1. A method for manufacturing a rotary anode assembly for an X-ray tube, consisting of a rotary anode base element and of a shaft joined to it, wherein the base element consists of graphite or another highly heat-resistant material based on carbon or ceramic and is provided with a focal track coating applied by a coating process and generating X radiation, characterized in that in a first step, a base element blank without an axial through-hole drilled in it and with excess dimensions is materially bonded to the shaft into a rotary a node assembly, and in that in further succession, the mechanical machining of the rotary anode assembly to near final-form dimensions, the application of the focal track coating and optionally, a final mechanical re-machining take place, wherein the axis of rotation of the shaft is employed as the dimension reference for the respective mechanical machining steps.

2. The method for manufacturing a rotary anode assembly according to claim 1, characterized in that a soldering process is used for materially bonded joining of the shaft to the base element.

3. The method for manufacturing a rotary anode assembly according to claim 1, characterized in that the further processing of the rotary anode assembly takes place by turning the base element to nearly final-form dimensions, by application of the focal track layer by means of vacuum plasma spraying, and by subsequent grinding of the track coating to the final dimensions.

4. The method for manufacturing a rotary anode assembly according to claim 1, characterized in that, in the application of the focal tack coating, the axis of the shaft is utilized as the dimension reference for the execution of the coating.

5. The method for manufacturing a rotary anode assembly according to claim 1, characterized in that rhenium is employed as the material for the focal track coating, and the focal track coating is produced with layer thickness of 60–150 $\mu$m.

6. The methodfor manufacturing a rotary anode assembly according to claim 5, characterized in that the focal track coating is made roughly 100 $\mu$m thick.

* * * * *

UNITED STATES PATENT AND TRADEMARK OFFICE

CERTIFICATE OF CORRECTION

PATENT NO. : 5,993,280

DATED : November 30, 1999

INVENTOR(S) : Dr. Peter RODHAMMER, et al.

It is certified that error appears in the above-identified patent and that said Letters Patent is hereby corrected as shown below:

In The Claims:

Claim 1, lines 9 and 10, change "a node assembly" to --anode assembly--;

Claim 3, line 6, after "grinding of the" and before "track" insert --focal--;

Claim 6, line 1, change "methodfor" to --method for--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*